United States Patent [19]

Byrne

[11] Patent Number: 4,476,630

[45] Date of Patent: Oct. 16, 1984

[54] RAZOR WITH SLIDING BLADE COVER

[75] Inventor: David S. Byrne, Atlantic Highlands, N.J.

[73] Assignee: Warner-Lambert Company, Morris Plains, N.J.

[21] Appl. No.: 332,986

[22] Filed: Dec. 21, 1981

[51] Int. Cl.[3] ..... B26B 21/02

[52] U.S. Cl. ..... 30/47; 30/77; 30/84

[58] Field of Search ..... 30/80, 83, 84, 85, 79, 30/90, 89, 30, 34 R, 66, 286, 50, 74, 74.1, 75; 222/560

[56] References Cited

U.S. PATENT DOCUMENTS

| | | | |
|---|---|---|---|
| 2,258,002 | 10/1941 | DeKay | 222/560 X |
| 2,298,944 | 10/1942 | Hyatt | 30/74.1 |
| 3,986,258 | 10/1976 | Liedtke | 30/30 |
| 4,328,615 | 5/1982 | Bowman et al. | 30/47 X |
| 4,345,374 | 8/1982 | Jacobson | 30/50 |

*Primary Examiner*—E. R. Kazenske
*Assistant Examiner*—Douglas D. Watts
*Attorney, Agent, or Firm*—R. S. Strickler

[57] ABSTRACT

A low cost razor for wet shaving having a permanently attached sliding blade cover and a cooperating cover actuating button connected to the cover by a flexible element.

3 Claims, 5 Drawing Figures

RAZOR WITH SLIDING BLADE COVER

BACKGROUND OF THE INVENTION

The present invention relates to razors for wet shaving and relates in particular to razors of this class which are fitted permanently with a cover which is slidable to and fro to cover and uncover the blade edge.

The use of the language "blade" or "blade edge" is intended to include one or more blades and a corresponding number of blade cutting edges.

Representative prior art razors over which the present invention is an improvement are disclosed and described in copending U.S. patent application Ser. Nos. 108,747 and 275,475, filed Dec. 31, 1979, and June 19, 1981, by Bowman et al. and Chen, respectively.

The '747 application shows a cover 14 slidable from a first position in which the blade edge 28 is properly exposed for shaving as shown in FIG. 2 to a second position in which the blade edge is covered and protected as shown in FIG. 3.

The '475 application also shows a slidable cover, permanently attached to the razor, which is movable to and fro to expose and cover the blade edge by means of lever systems.

For example, FIGS. 1 and 7 of the '475 application show levers 21 and 210 respectively which engage mating covers 14 and 140 and are manually operable to move the cover.

An important feature of the present invention is the provision of a low cost wet razor having a sliding cover where the cover is moved to and fro to expose or cover the blade edge by manipulation of an actuating button which makes a flexible connection with the cover.

SUMMARY OF THE INVENTION

A representative embodiment of the present invention embracing basic features thereof may comprise a razor including a blade having a cutting edge carried by a blade support connected to a handle, a cover permanently attached to the blade support and slidable to and fro to expose or cover the cutting edge, an actuating button carried by the razor and slidable thereon and a flexible element connecting the actuating button and the cover so that sliding motion of the button generates sliding motion in the cover.

Other features and advantages of the present invention will become more apparent from an examination of the following specification when read in conjunction with the appended drawings, in which:

DESCRIPTION OF PREFERRED EMBODIMENT

Figure 1:
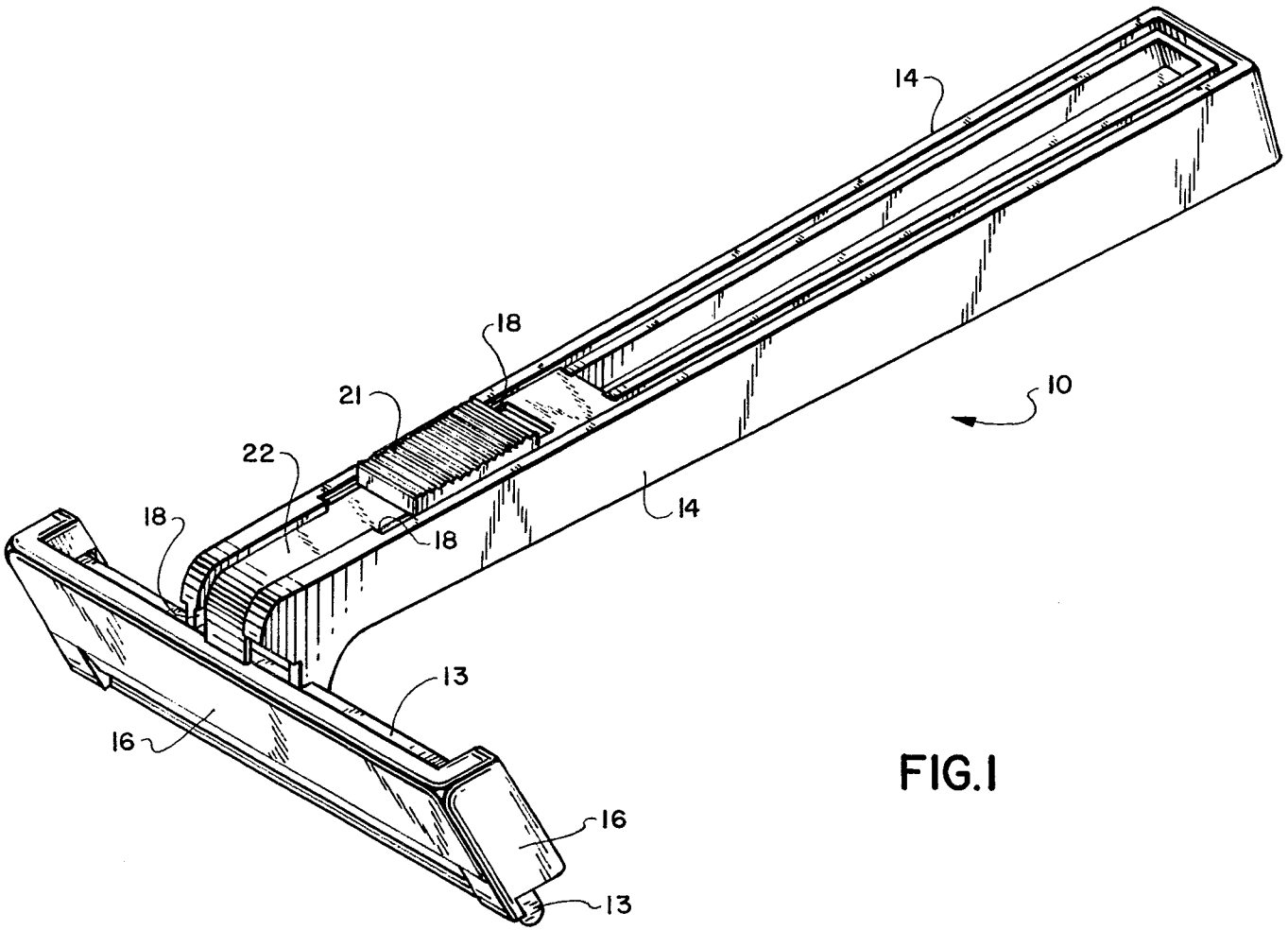
FIG. 1 shows the general configuration of a razor embracing this invention.

Referring in detail to the drawings, in particular FIGS. 1 through 5, the reference numeral 10 designates a low cost wet razor having one or more blades 11, each having a blade cutting edge 12 seated on a body portion of blade support 13 terminating in a handle 14.

Figure 2:
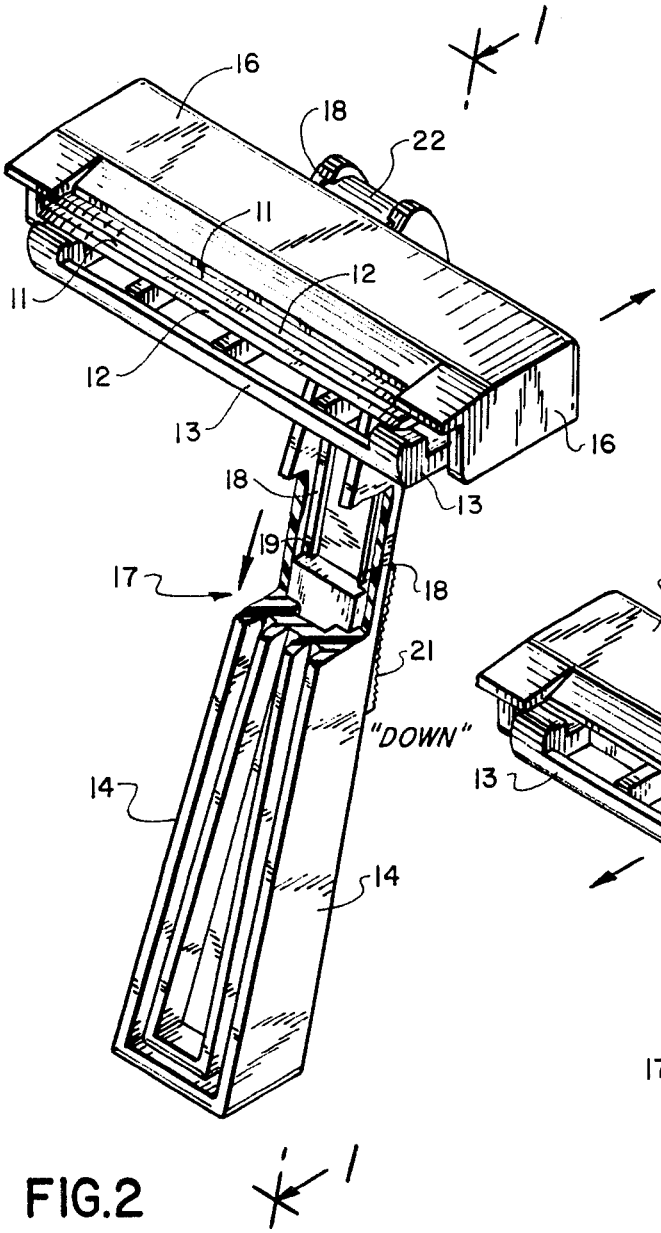
FIG. 2 is a perspective view of the razor of the present invention, with portions broken away for clarity, in which the blade edge is properly exposed for shaving and the actuating button is in the "down" position.
Figure 3:
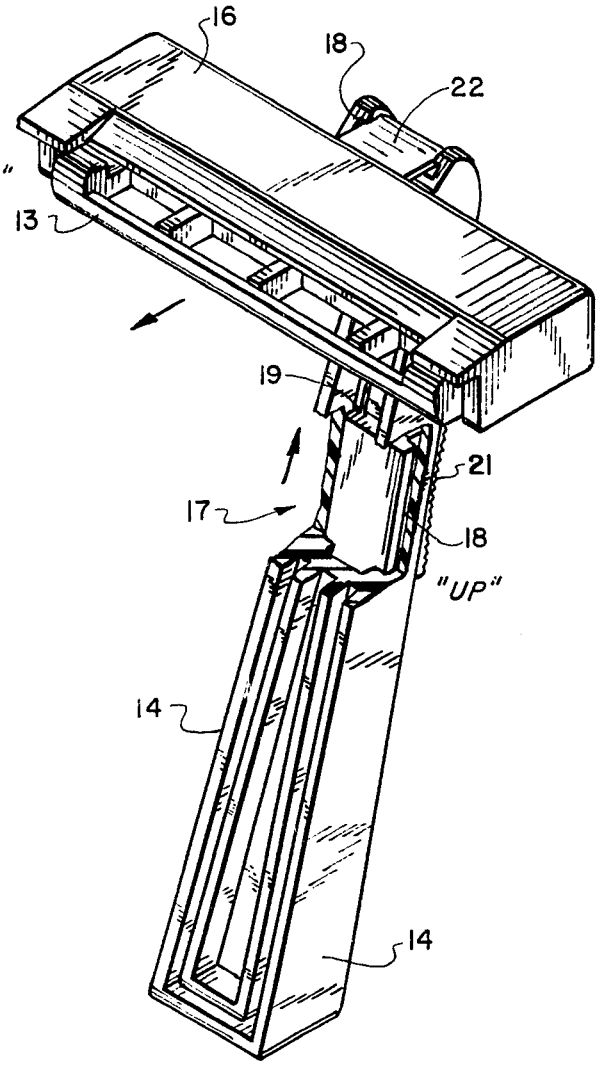
FIG. 3 is a similar view showing the sliding cover in the closed (blade edge protected) position and the actuating button is in the "up" position.
Figure 5:
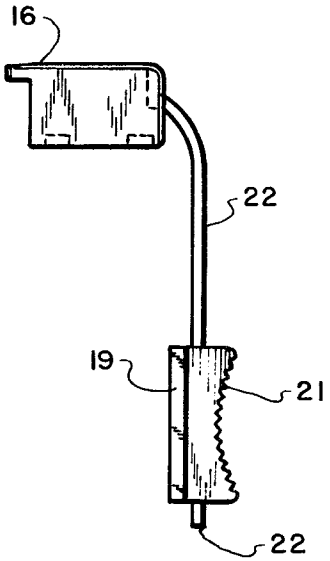
FIG. 5 is a side elevation of the illustration of FIG. 4 as viewed from the right side of FIG. 4.
Figure 4:
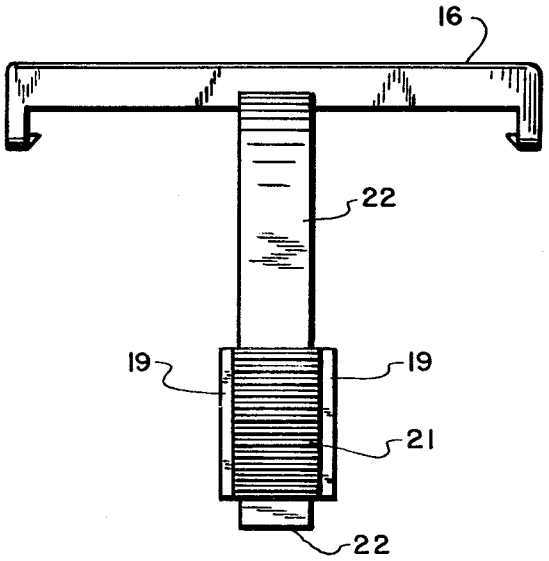
FIG. 4 shows a plan view of the cover, actuating button and the flexible connecting element as a single piece-art.

The blade support 13 carries a cover 16 which is permanently attached and slidable along a track defining a first line of action in the blade support from the open or operative position of FIG. 2 to the closed or protected (blade and blade cutting edge protected) position of FIG. 3.

The cover sliding action occurs as disclosed and described in said copending applications.

The handle 14 is formed with a track defining a second line of action indicated generally at 17 defining opposed elongated recesses or slots 18—18 which receive mating wings or fins 19—19 (FIG. 4) formed on a sliding actuating button 21.

The button 21 is connected to the cover 16 by a flexible element 22.

Note that the cover 16, button 21 and element 22 can be fabricated (molded) as a single piece-part (FIGS. 4 & 5) as considerations of high-speed mass production techniques and economics dictate.

Alternatively the three members (cover 16, element 22 and button 21) can be made individually, each of the same or different starting materials, including plastics and metal, and subsequently secured together by any suitable means such as gluing, riveting, high frequency welding or the like.

The unit may be assembled in the following fashion:

Utilizing a single piece-part embracing the button, cover and flexible connecting element, the wings or fins 19—19 of the button 21 are started into the slots 18—18 from the top of the razor. The button is moved downwardly in sliding fashion along track 17 in handle 14 toward the down position bringing the cover 16 in proper registration with the blade support 13. The registration position is disclosed and described in said copending '747 application.

At this point the cover is snapped into permanent connection with the blade support and thereafter motion of the actuating button 21 "up and down" along its track (the second track) will move the cover 16 to and fro along its track (the first track) through the instrumentality of the flexible connecting element 22.

Thus the "down" position of the button corresponds to the open position of the cover with proper blade exposure for wet shaving.

Correspondingly, the "up" position of the button corresponds to a closed position of the cover with the blade and blade cutting edge covered and protected.

What is claimed is:

1. In a disposable wet shaving razor of the type having a guard bar, a permanently attached cover overlaying the razor and slidable relative to the guard bar along a first track defining a first line of action from a first position in which the relationship between the cover and the guard bar renders the razor operable to a second position in which the relationship between the cover and the guard bar renders the razor inoperable, a mechanism for driving the cover relative to the guard bar comprising a slidable operating button, a flexible element connecting the cover to the button and a second track defining a second line of action for guiding the button so that sliding motion of the operating button along the second track drives the cover selectively along the first track to said first and second positions, said flexible element curving from said first line of action to said second line of action, said cover, said flexible element and said operating button being fixed together to define a unitary assembly and said tracks being substantially perpendicular to one another.

2. In a disposable wet shaving razor of the type having a body portion with a guard bar for supporting a fixed blade including a permanently attached slidable blade cover, said body portion terminating in a handle, said handle being disposed generally perpendicular to the blade and blade cover, a mechanism for actuating the cover relative to the body portion and the guard bar along a first line of action comprising a slidable operating button carried by the handle making a flexible connection with the cover and track means defining a second line of action in the razor handle for engaging and guiding the button such that sliding motion of the button along the handle slides the cover along the body portion relative to the guard bar and blade, said flexible connection curving from said first line of action to said second line of action through at least 90 degrees and said cover, said flexible connection and said operating button defining a unitary assembly.

3. In a disposable razor of the type including a body portion, a handle, a fixed blade having a cutting edge, a guard bar fixed to the body portion and a permanently attached blade cover slidable along a first line of action attached to the body portion and overlaying the blade, a mechanism for driving the cover comprising a slidable operating button having opposed fins, a flexible element connecting the cover and the button and a track formed in the handle defining a second line of action cooperating with the fins for guiding the button and the flexible element so that sliding motion of the operating button along the track slides the cover along the body portion to cover the cutting edge to render the cutting edge inoperative while the flexible element traverses both lines of action, said cover, said flexible element and said operating button defining a unitary assembly and said lines of action being substantially perpendicular to one another.

* * * * *